US005727931A

United States Patent [19]

Lash et al.

[11] Patent Number: 5,727,931

[45] Date of Patent: Mar. 17, 1998

[54] PUMP FOR ELECTRICALLY CONDUCTIVE COATING MATERIALS

[75] Inventors: Edward Lash, Spencer; Ronald D. Konieczynski, North Royalton, both of Ohio

[73] Assignee: Nordson Corporation, Westlake, Ohio

[21] Appl. No.: 633,693

[22] Filed: Apr. 19, 1996

[51] Int. Cl.[6] ..... F04B 17/00

[52] U.S. Cl. ..... 417/392; 417/399; 92/151

[58] Field of Search ..... 417/399, 392; 92/151

[56] References Cited

U.S. PATENT DOCUMENTS

| | | | |
|---|---|---|---|
| 277,305 | 5/1883 | Maltby . | |
| 482,776 | 9/1892 | Avery . | |
| 648,153 | 4/1900 | Serve . | |
| 1,074,051 | 9/1913 | Hohenstein et al. | 417/399 |
| 1,549,332 | 8/1925 | Roberts . | |
| 1,582,212 | 4/1926 | Folberth et al. | 417/392 X |
| 1,974,236 | 9/1934 | Cantacuzene | 417/392 X |
| 2,811,950 | 11/1957 | Entz | 121/38 |
| 2,828,610 | 4/1958 | Bruehl | 60/51 |
| 2,984,225 | 5/1961 | Young | 417/399 |
| 3,063,423 | 11/1962 | Riordan | 121/38 |
| 3,104,619 | 9/1963 | Swarthout . | |
| 3,818,807 | 6/1974 | Semple | 92/86.5 |
| 4,313,475 | 2/1982 | Wiggins | 141/18 |
| 5,078,168 | 1/1992 | Konieczynski | 137/566 |
| 5,197,676 | 3/1993 | Konieczynski et al. | 239/690 |
| 5,221,194 | 6/1993 | Konieczynski et al. | 417/430 |
| 5,341,990 | 8/1994 | Konieczynski | 239/3 |

FOREIGN PATENT DOCUMENTS 28 53 347 12/1978 Germany .

*Primary Examiner*—Richard E. Gluck
*Attorney, Agent, or Firm*—Holland & Knight LLP

[57] ABSTRACT

A piston pump, particularly adapted for use in a system for supplying and dispensing electrically conductive coating material, includes a pump housing having an outer wall, opposed first and second ends and a hollow interior separated into a first cavity and a second cavity by a centrally disposed divider plate. A connector rod extends through a bore formed in the divider plate, and mounts first and second piston heads on opposite ends thereof which move in tandem in a first direction in response to the introduction of coating material into the second cavity, and in a second direction when pressurized air is introduced into the first cavity to discharge the coating material from the second cavity.

26 Claims, 4 Drawing Sheets

PUMP FOR ELECTRICALLY CONDUCTIVE COATING MATERIALS

FIELD OF THE INVENTION

This invention relates to systems for supplying and dispensing electrically conductive coating materials, and, more particularly, to a supply system which employs one or more pumping units in which seal failure and intermixture of air and coating material is substantially reduced.

BACKGROUND OF THE INVENTION

The application of coating materials using electrostatic spraying techniques has been practiced in the industry for many years. In these applications, the coating material is discharged in atomized form and an electrostatic charge is imparted to the atomized particles which are then directed toward a substrate maintained at a different potential to establish an electrostatic attraction for the charged, atomized particles. In the past, coating materials of the solvent-based variety, such as varnishes, lacquers, enamels and the like, were the primary materials employed in electrostatic coating applications. The problem with such coating materials is that they create an atmosphere which is both explosive and toxic. The explosive nature of the environment presents a safety hazard should a spark inadvertently be generated, such as by accidentally grounding the nozzle of the spray gun, which can ignite the solvent in the atmosphere causing an explosion. The toxic nature of the workplace atmosphere created by solvent coating materials can be a health hazard should an employee inhale solvent vapors.

As a result of the problems with solvent-based coatings, the recent trend has been to switch to water-based coatings which reduce the problems of explosiveness and toxicity. Unfortunately, this switch to water-based type coatings has sharply increased the risk of electrical shock, which risk was relatively minor with solvent-based coatings. The problem of electrical shock has been addressed in U.S. Pat. Nos. 4,313,475; 5,078,168; 5,197,676; and 5,341,990, all owned by the assignee of this invention. In systems of this type, a "voltage block" or air gap is provided between one or more sources of the conductive coating material and the electrostatically charged coating material which is directed to the coating dispensers. This voltage block ensures that there is never an electrical path between the source of water-based coating material and the high voltage electrostatic power supply.

In systems of the type disclosed in the patents mentioned above, a voltage block device is provided which includes a filling station connected to one or more sources of coating material, a discharge station physically spaced from the filling station and connected to one or more coating dispensers, and, a shuttle movable between the filling station and discharge station. The shuttle is connected through coupling elements and supply lines to the inlet of a pump, preferably a piston pump, which receives coating material from the source when the shuttle is located at the filling station. The shuttle also has coupling elements connected by transfer lines to the outlet of the piston pump which is effective when the shuffle is located at the discharge station to transfer coating material to one or more coating dispensers. An air gap is continuously maintained between the source of coating material and the electrostatically charged coating dispensers by the controlled movement of the shuttle between the filling station and discharge station.

In some older systems, including that disclosed in U.S. Pat. No. 4,313,475, the coating material is transferred to and from the pumping units under the application of pressurized air which is allowed to come into direct contact with the coating material to force it to and from the pumping unit. It has been found that contact with air can degrade many types of coating materials, and therefore it is desirable to isolate the coating material from the air until it is applied to a particular substrate.

In an effort to avoid the problem of exposure of the coating material with air, piston pumps have been employed in transfer systems of the type described above which generally comprise a cylindrical wall defining a reservoir within which a piston, including a piston head connected to a piston rod, is axially movable. Air or other operating fluid is applied to one side of the piston head which forces the coating material located on its other side out of the reservoir. In many piston pumps, the piston head is formed with one or more circumferential grooves, each of which carry a seal in a position to slidably engage the walls of the cylinder. While piston pumps of this type avoid the problem of direct contact of air and paint, other limitations have been observed in their operation.

One problem with piston pumps of the type described above is that the seals on the piston head are not effective to completely wipe the cylinder wall clean of coating material as the piston head reciprocates within the reservoir. Consequently, a thin film of coating material can form along the cylinder wall which is dried by contact with the operating air introduced into the reservoir as the piston head is reciprocated therein. This dried paint leaves an abrasive, high friction residue on the cylinder wall which can create erratic piston motion and lead to premature failure of the seals. Additionally, such paint deposits can get sufficiently tacky or sticky to substantially restrict the motion of the piston head, particularly if the system operation is interrupted for a period of time for any reason.

Another problem with piston pumps of the type described above is a phenomenon known as "pressure trap." This condition is caused by a differential rate of wiping of the coating material from the walls of the cylinder in piston pumps wherein the piston head is provided with two or more circumferentially extending seals which are axially spaced from one another. A reservoir of coating material can build up in the axial space(s) between the seals which forces the seal opposite the pressurized side of the piston against its groove in the piston head. For example, when pressurized air is introduced in the reservoir of the pump on one side of the piston head, the coating material caught within the axial space between the seals is forced in a direction toward the coating material side of the piston, which, in turn, forces the seal closest to the coating material against the lip of the groove in the piston head. When the opposite side of the piston head is pressurized, e.g., upon receipt of coating material, the coating material captured between the seals is forced in the opposite direction, toward the air side of the piston head, thus causing the seal closest to the air side to be forced against its groove in the piston head. This problem of pressure trap causes additional drag on the system and accelerated seal wear.

Problems with piston pumps for electrically conductive coating materials have been addressed in U.S. Pat. No. 5,221,194, owned by the assignee of this invention. The piston pump disclosed in the '194 patent includes a piston rod having one end connected to the piston head, and a second end extending outwardly from the reservoir of the pump through a bore in the end of the housing. The piston rod is formed with an axial bore which enters the piston head and intersects at least four branch passageways form therein.

These passageways extend radially outwardly from the piston rod bore to the outer periphery of the piston head at a location between two annular, circumferential grooves formed therein, each of which carry a piston seal. The end of the piston shaft extending outwardly from the reservoir is preferably connected by a fitting to a section of plastic tubing having a vented cap which contains a lubricating fluid such as water.

Water is transmitted at ambient pressure from the tubing, through the bore in the piston shaft, and radially outwardly within each of the branch passageways to the outer periphery of the piston head in between the piston seals. The water forms a lubricant along the cylinder walls of the pump housing to facilitate movement of the piston head within the cylinder. The presence of water between the seals is also intended to prevent cross-contamination between the paint and air size of the piston head. Air which might leak past one of the seals is captured within the water between the seals and eventually flows upstream along the branch passageways and bore in the piston shaft to the plastic tube where it is vented. Similarly, coating material which leaks past either seal is mixed with the water in the space between the seals and eventually flows upstream along the branch passageways and piston shaft bore to the plastic tube.

It has been found what while the piston pump of U.S. Pat. No. 5,221,194 provides an improvement over other pumping devices, it nevertheless has limitations in certain applications. As with many other pump designs, the effectiveness of the seal created between the piston head and walls of the pump housing is of principal importance in the effective operation of the pump. This seal, in turn, is dependent to a substantial extent on the degree of concentricity of the circular-shaped pump head and the cylindrical wall of the pump housing. Concentric movement of the piston head within the pump interior is also dependent on the accurate positioning of the piston rod connected to the piston head which extends through the bore in one end of the pump housing. It has been found that even relatively small discrepancies in concentricity between the piston head and cylinder wall can create premature seal wear, and contribute to leakage past the seals. As such, pressurized air from one side of the piston head can enter the coating material on the opposite side thereof, and vice-versa. The exposure of coating material to pressurized air not only causes degradation as noted above, but the presence of air within the coating material can result in imperfections in the finish of the coating material applied to a particular substrate.

SUMMARY OF THE INVENTION

It is therefore among the objectives of this invention to provide a system for applying electrically conductive coating material including a piston pump which exhibits improved seal wear, which substantially prevents leakage of coating material and/or air past the seals, and, which is not dependent upon substantially perfect concentricity between the piston head and walls of the cylinder housing of the pump to obtain an acceptable seal therebetween.

These objectives are accomplished in a piston pump particularly adapted for use in a system for supplying and dispensing electrically conductive coating material which includes a pump housing having an outer wall, opposed first and second ends and a hollow interior separated into a first cavity and a second cavity by a centrally disposed divider plate. A connector rod extends through a bore formed in the divider plate, and mounts first and second piston heads on opposite ends thereof in position within the first and second cavities, respectively. A fluid inlet is formed in the housing to permit the introduction of coating material into the second cavity, and an air inlet is formed in the housing so that pressurized air can be introduced into the first cavity. The first and second piston heads move in tandem in a first direction in response to the introduction of coating material through the fluid inlet into the second cavity, and in a second direction when pressurized air is introduced into the first cavity to discharge the coating material from the second cavity.

An important aspect of this invention is predicated upon the concept of allowing each of the piston heads to "center" themselves along the wall of the pump housing within their respective first and second cavities. This is achieved by forming the bore in the divider plate with a large enough diameter to allow the corrector rod to shift or pivot to at least a limited extent with respect to its longitudinal axis. In turn, the first and second piston heads attached to either end of the connector rod are permitted to shift with respect to the wall of the pump housing in the event of a discrepancy between the dimensions of the piston heads and housing wall(s). As such, the peripheral edges of the first and second piston heads do not have to be perfectly concentric with the housing wall in order to form an acceptable seal. This reduces seal wear, and substantially prevents problems of leakage and cross-contamination between the coating material contained in the second cavity and the pressurized air introduced in the first cavity.

In the presently preferred embodiment, the cylinder housing is formed with a lubricant inlet which permits the introduction of a liquid lubricant into the second cavity at a location between the divider plate and the side of the second piston head opposite where the coating material is introduced. The lubricant is allowed to pool on the surface of the second piston head and functions to essentially continuously coat the wall of the cylinder housing within the second cavity along which the second piston head is axially movable. This further reduces seal wear, and also provides essentially a barrier between the coating material on one side of the second piston head within the second cavity and the pressurized air introduced into the first cavity on the oppositely facing side of the first facing head.

It is contemplated that the piston pump of this invention can be utilized with a variety of different systems for dispensing electrically conductive coating material which employ voltage block devices of the type described above. In these systems, the shuttle of the voltage block device is movable to the filling station in order to transfer coating material from a source into the piston pump, and then coating material is discharged from the pump to one or more coating dispensers upon movement of the shuttle to the discharge station. In order to initiate movement of the shuttle between the filling station and discharge station, the piston pump of this invention is provided with a pair of sensors. One sensor is carried by the first end of the housing and the other sensor is mounted to the divider plate, both of which extend into the interior of the first cavity in position to engage the first piston head. As the coating material enters the second cavity and the first and second piston heads move in tandem toward the first end of the housing, the first piston head contacts the first sensor and sends a signal to a control device indicative of a "filled" condition of the piston pump, i.e., wherein the second cavity is filled with coating material. In response to this signal, the control device causes the shuttle to move from the filling station to the discharge station in preparation for transfer of coating material from the now filled piston pump to one or more coating dispensers which occurs when the control device directs pressurized air into the first cavity. The first and second piston heads move in the opposite direction in the course of discharging coating material from the second cavity of the pump, and when the second cavity reaches a selected low level, the first piston head engages the sensor carried by the divider plate. This second sensor sends a corresponding signal to the control device indicative of an "empty" condition of the pump, at which time the control device causes the shuttle to move from the discharge station to the filling station in preparation for the transfer of new coating material from the source into the second cavity of the pump.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
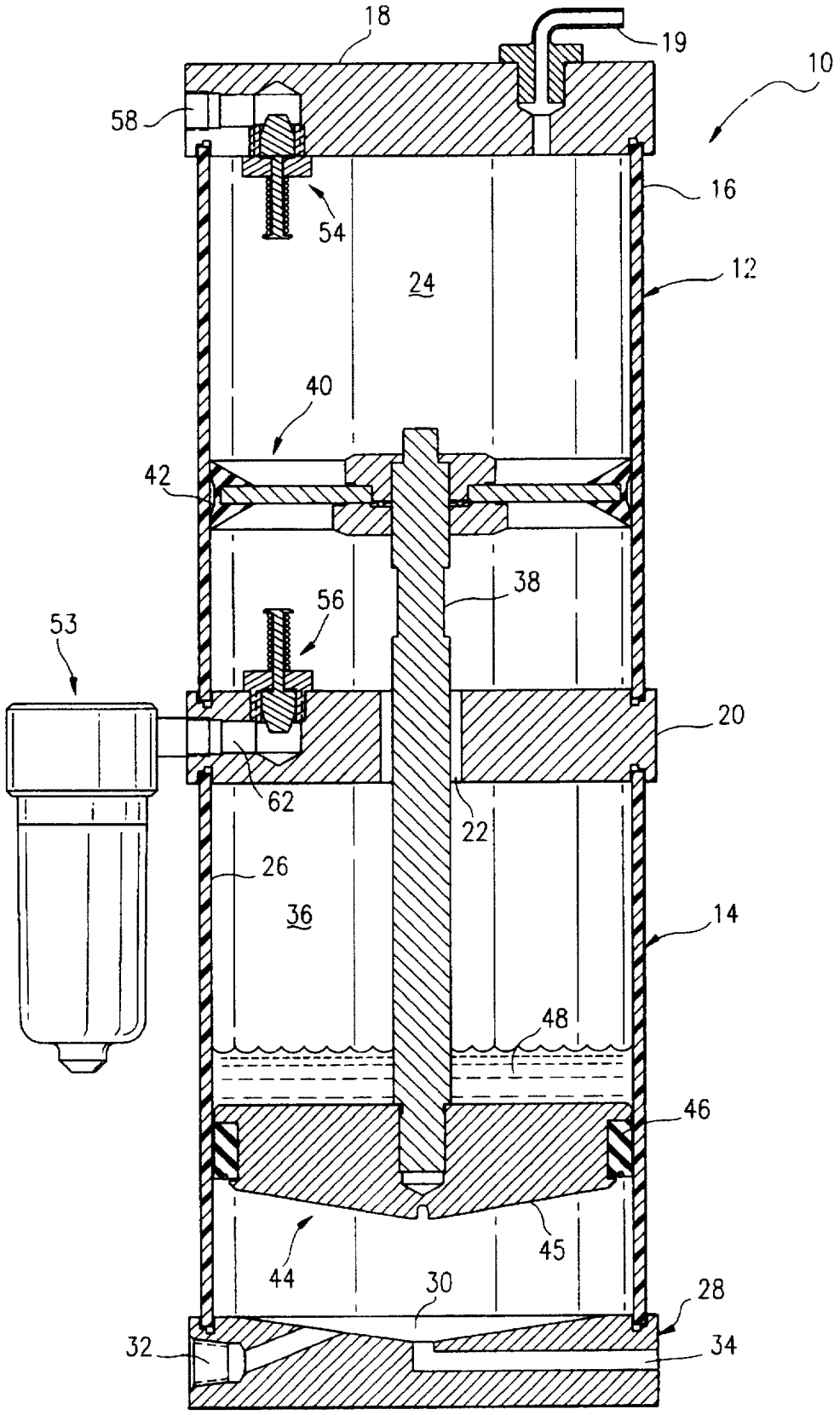
FIG. 1 is a cross-sectional view of one embodiment of the piston pump of this invention.

Referring initially to FIG. 1, the piston pump 10 of this invention is formed in essentially two sections including an upper housing 12 and a lower housing 14. For purposes of the present discussion, the terms "upper" or "top" refer to the vertically upwardly direction with the pump in the orientation depicted in FIG. 1, whereas the terms "lower" or "bottom" refer to the opposite direction. The upper housing 12 has a cylindrical wall 16 which is mounted at its upper end to a cap 18, and at the lower end to a divider plate 20 formed with a central bore 22. The wall 16 of upper housing 12 is hollow defining an upper cavity 24 extending between the cap 18 and divider plate 20. Preferably, the cap 18 is formed with an air inlet 19 for receiving pressurized air as described below.

The lower housing 14 is similar in construction to the upper housing 12. In the presently preferred embodiment, the lower housing 14 includes a cylindrical wall 26 mounted between the bottom of divider plate 20 and a base 28. The base 28 is preferably formed with a dished or concavely shaped upper surface 30, a fluid inlet 32 and a fluid outlet 34. The cylindrical wall 26 of lower housing 14 forms a lower cavity 36 extending between the bottom surface of divider plate 20 and the upper surface 30 of base 28.

A connector rod 38 extends through the central bore 22 in divider plate 20, and has a smaller diameter than that of the central bore 22 allowing it to "float" or shift position with respect to its longitudinal axis, for purposes to become apparent below. The upper end of connector rod 38 mounts an upper piston head 40, and the lower end of connector rod 38 mounts a lower piston head 44. As shown in FIG. 1, the bottom surface 45 of lower piston head 44 is formed in a convex shape corresponding to the concave upper surface 30 in the base 28. The peripheral edges of upper and lower piston heads 40, 44 each mount a circumferential seal 42 and 46, respectively. As described below in connection with a discussion of the operation of piston pump 10, the upper piston head 40 is axially movable within upper cavity 24 whereas the lower piston head 44 is axially movable within the lower cavity 36 so that their seals 42 and 46 engage the respective walls 16 and 26 of upper and lower housings 12, 14.

Figure 2:
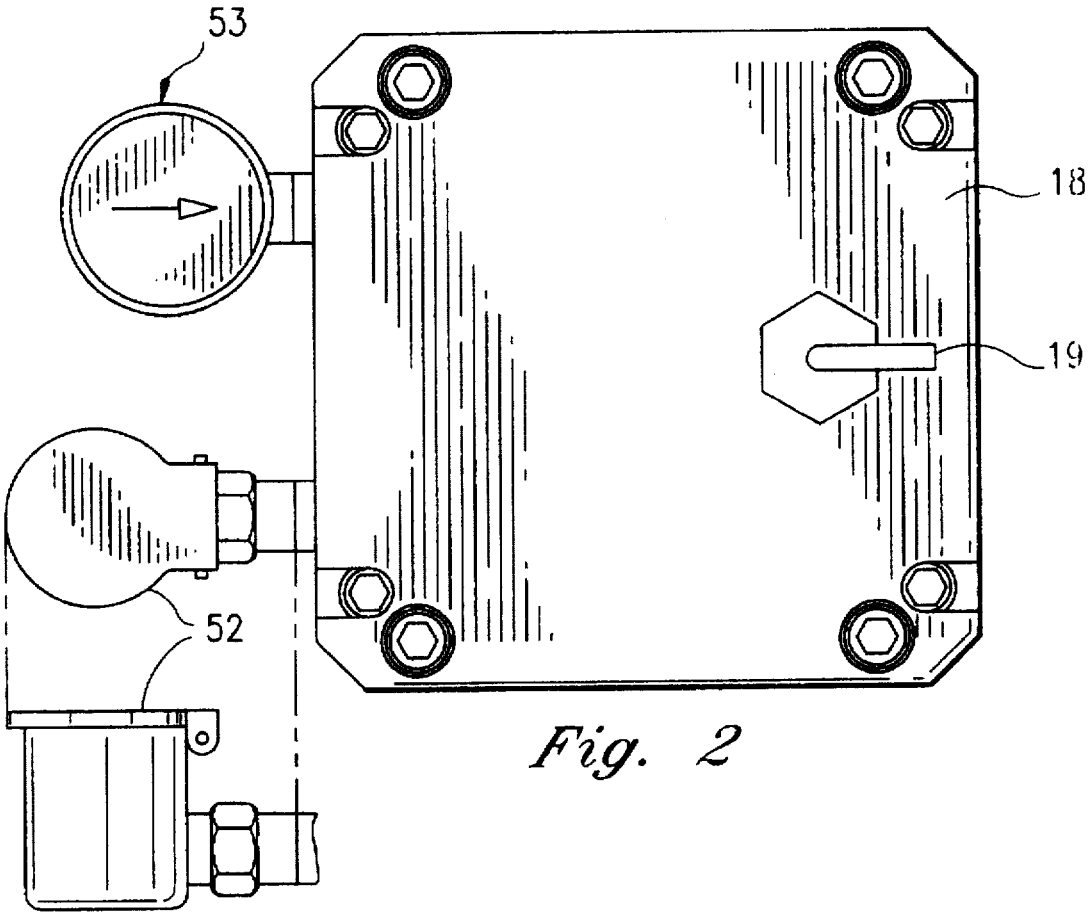
FIG. 2 is a plan view of the piston pump of FIG. 1.

As depicted in FIG. 1, a quantity or layer 48 of lubricant is carried on the top surface of lower piston head 44 at a location between the divider plate 20 and lower piston head 44 within lower cavity 36. The lubricant is introduced into the lower cavity 36 through a passageway (not shown) formed in the divider plate 20 having an inlet end connected to a container 52 located externally of the piston pump 10 and containing lubricant. See also FIG. 2. The lubricant is poured into the container 52 where it flows through divider plate 20 and is allowed to pool atop the lower piston head 44 to form layer 48. As described more fully below, the lubricant layer 48 is intended to assist in the smooth movement of the lower piston head 44 along the cylindrical wall 26 within lower cavity 36 during operation of piston pump 10, and to provide a barrier between the upper and lower cavities 24, 36. A vent reservoir 53 is also connected by a passageway (not shown) in divider plate 20 to the area within pump 10 between the upper and lower piston heads 40 and 44. The purpose of vent reservoir 53 is to provide a repository for pressurized air, excess lubricant and any coating material which may escape past the seal 46 of lower piston head 44.

Figure 4:
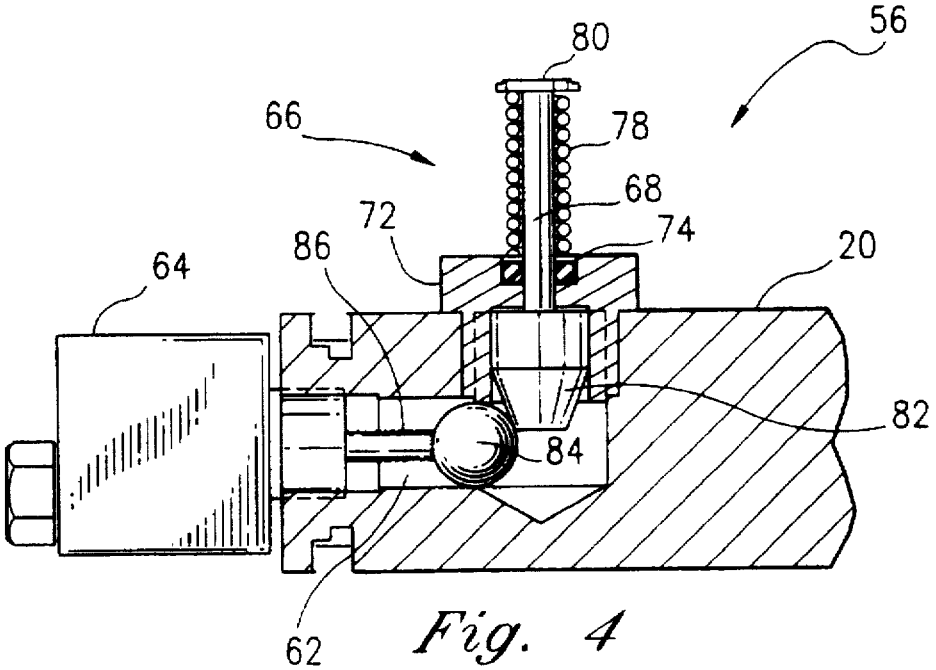
FIG. 4 is a partial, cross-sectional view of the sensors employed in the piston pumps of FIG. 1 and 3.

With reference to FIGS. 1 and 4, the upper cavity 24 of pump 10 is provided with upper and lower sensors 54 and 56, respectively. Upper sensor 54 is mounted to the cap 18 at one end of a bore 58 whose outer end mounts a pneumatic valve 60 preferably of the type available from Clippard Industries, under Model No. MJV-3 or MJV0-3. The lower sensor 56 is mounted to the divider plate 20 at one end of a bore 62 formed therein, whose opposite end mounts a valve 64 similar to valve 60. Each sensor 54, 56 has the identical construction, and therefore only lower sensor 56 is described in detail. With particular reference to FIG. 4, the lower sensor 56 includes a plunger 66 having a stem 68 which is slidably received within a stepped bore formed in a bushing 72 threaded into one end of the bore 58 in cap 18. An O-ring 74 sealingly engages the stem 68 of plunger 66 to create a seal with bushing 72. A coil spring 78 extends between the O-ring 74 and a head portion 80 formed at the outwardly extending end of the plunger stem 68. The opposite end of plunger stem 68 mounts a tapered element 82 in position to engage a ball 84 carried within the interior of bore 62. This ball 84, in turn, is sandwiched between the tapered element 82 of stem 68 and a valve stem 86 associated with valve 64. As noted above, upper sensor 54 is identical in construction to lower sensor 56, and is therefore not described separately herein.

Figure 3:
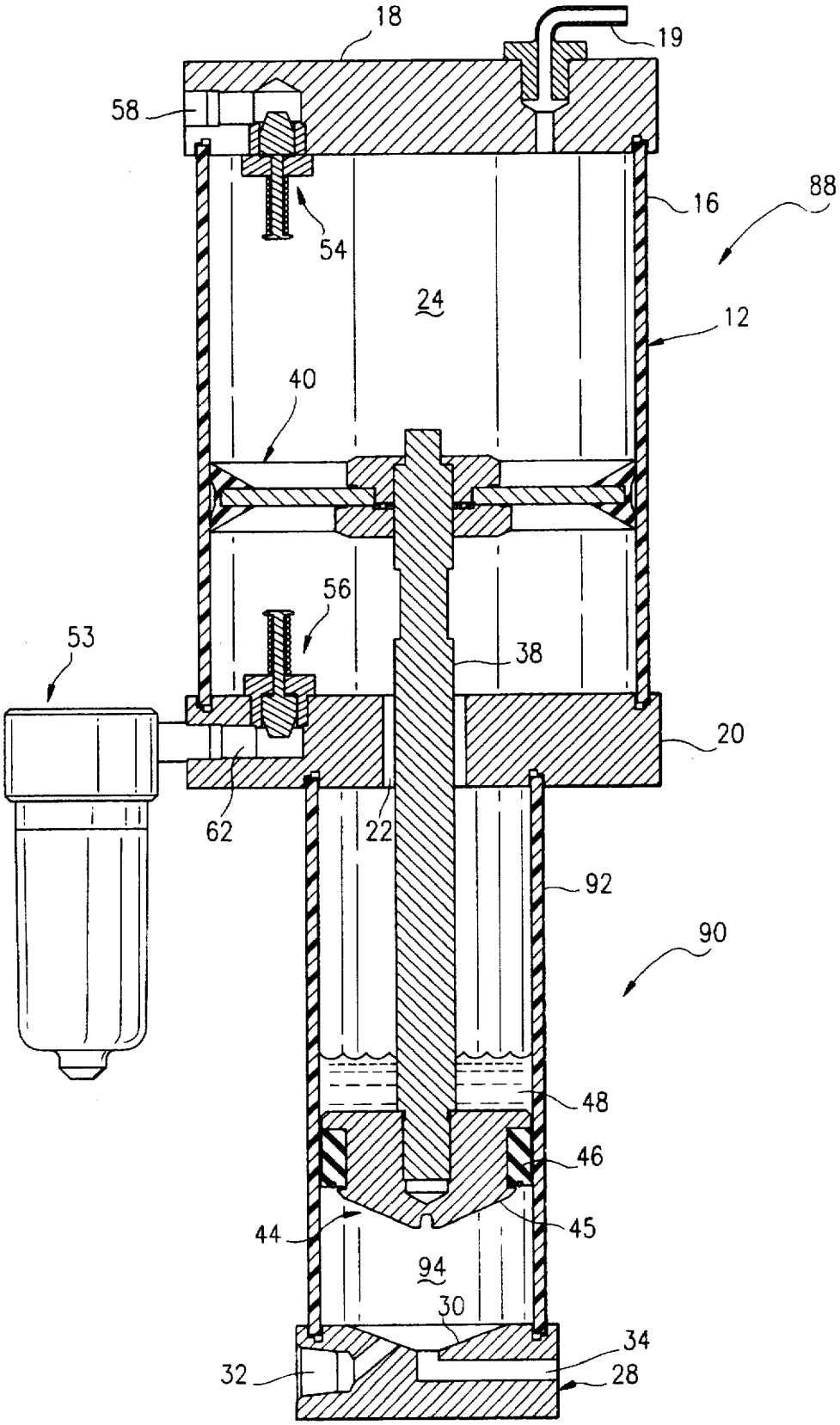
FIG. 3 is an alternative embodiment of the piston pump depicted in FIG. 1.

Referring to FIG. 3, an alternative embodiment of a piston pump 88 is depicted which is similar in most respects to piston pump 10. As such, the same reference numbers are utilized in FIG. 3 to identify the same structure previously discussed in connection with piston pump 10. The principal difference between pumps 88 and 10 is that piston pump 88 is formed with a lower housing 90 having a cylindrical wall 92 which is smaller in diameter than the cylindrical wall 26 of upper housing 12. In the particular embodiment of piston pump 88 shown in FIG. 3, the cylindrical wall 92 is approximately 70% of the diameter of the cylindrical wall 16 of upper housing 12 and, therefore, the lower cavity 94 defined by cylindrical wall 92 is approximately half of the volume as that of the lower cavity 36 in piston pump 10. A reduced diameter lower piston head 96 is provided to accommodate the smaller size of lower cavity 94, but the connector rod 38, the upper piston head 40 and the volume of upper cavity 24 are the same in piston pump 88 as in piston pump 10. As a result, and as discussed more fully below, the pressure with which coating material can be discharged from the lower cavity 94 of piston pump 88 is approximately twice as great as the pressure obtained from piston pump 10 for the same level of pressurized air introduced into the upper cavity 24 of both pumps 10 and 88.

It should be understood that while a piston pump 88 is shown in FIG. 3 having a lower housing 90 and lower cavity 94 which are approximately half the area of upper housing 12 and upper cavity 24 of pump 10, other sizes of the lower housing 90 and lower cavity 94 could be utilized and are considered within the scope of this invention. The objective in reducing the relative size of the lower housing portion of piston pump 88 is to provide an economic and efficient way of increasing the output pressure of the pump 88 while utilizing essentially the same structural elements employed in the upper portion of piston pump 10.

OPERATION OF APPARATUS 10

Figure 5:
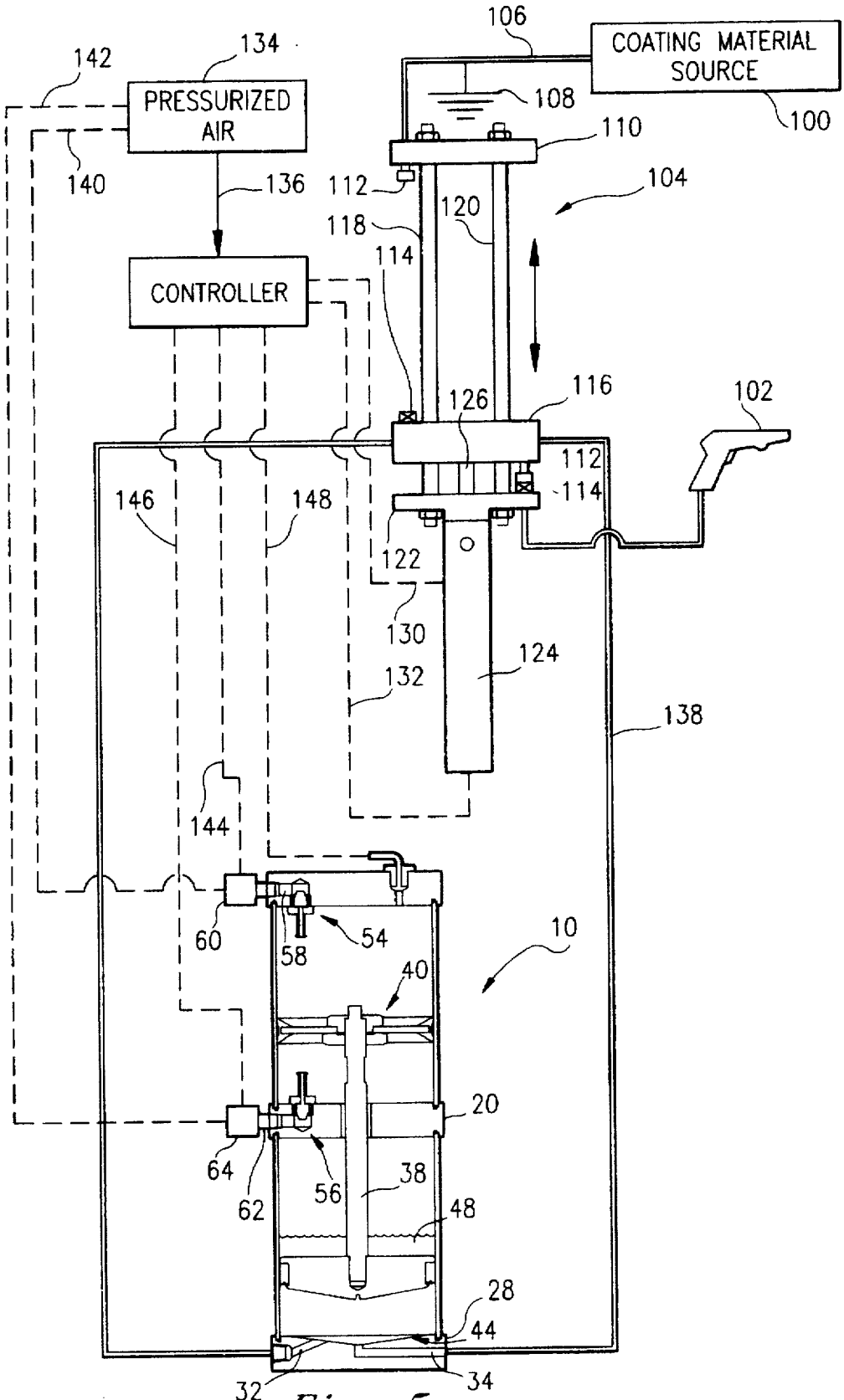
FIG. 5 is a schematic view of a system for delivering electrically conductive coating material employing the piston pump herein.

With reference initially to FIG. 5, it is believed that the operation of piston pump 10 can be more readily understood when explained in the context of a system 98 for the delivery of electrically conductive coating material from a source 100 to one or more coating dispensers 102. The system 98 depicted in FIG. 4 is shown schematically and is intended to be illustrative of a basic delivery system for electrically conductive coating material of the type which employs a voltage block device 104, such as specifically discussed in the patents owned by the assignee of this invention mentioned above. As such, the particular configuration of system 98 is not intended to be in any way limiting of the applicability of piston pump 10 in a delivery system for electrically conductive coating material, but is shown by way of example for ease of understanding of the operation of pump 10.

In the illustrated embodiment, the source 100 of coating material is connected by a supply line 106, grounded at 108, to the filling station 110 of the voltage block device 104. The filling station 110 mounts a male coupling element 112 which is mateable with a female coupling element 114 carried on a transfer shuttle 116 of the voltage block device 104. Preferably, the male and female coupling elements 112, 114 are of the type disclosed in U.S. Pat. No. 5,078,168, the disclosure of which is incorporated by reference in its entirety herein.

The shuttle 116 is movable along a pair of guide rods 118 and 120 which extend between the filling station 110 and a discharge station 122 of the voltage block device 104. The bottom surface of shuttle 116 mounts a male coupling element 112 which is mateable with a female coupling element 114 carried on the discharge station 122. The shuttle 116 is movable between the filling station 110 and discharge station 122 by operation of a cylinder 124 having a piston 126. In response to the extension of piston 126, as described below, the shuttle 116 is movable upwardly along guide rods 118, 120 to a filling position wherein the male coupling element 112 at the filling station 110 mates with the female coupling element 114 on the shuttle 116. When the cylinder piston 126 is retracted, the shuttle 116 is moved to a discharge position wherein the male coupling element 112 carried on the lower surface of shuttle 116 mates with the female coupling element 114 at the discharge station 122.

As described more fully below, extension and retraction of the piston 126 is governed by operation of a controller 128 which is connected to the cylinder 124 by air lines 130 and 132. The controller 128, in turn, is connected to a source of pressurized air 134 by a line 136. For purposes of the present discussion, the controller 128 can be essentially any commercially available progturnmable control device which includes pneumatic valves (not shown) connected to the air lines 130 and 132. The particular construction of controller 128 forms no part of this invention of itself and is therefore not described in detail herein.

As shown in FIG. 4, the shuttle 116 is connected by a fluid line 136 to the fluid inlet 32 of piston pump 10. The outlet 34 of pump 10 is connected by a fluid line 138 to the male coupling element 112 carried at the base of shuttle 116. Pressurized air is delivered to the upper valve 60 of pump 10 through air line 140 connected to source 134, and the lower valve 64 is connected by an air line 142 to air source 134. The outputs of upper and lower valves 60 and 64 are connected by lines 144 and 146, respectively, to the controller 128.

With the foregoing general description of system 98 in mind, the piston pump 10 operates as follows, it being understood that pump 88 functions in essentially the identical manner and is not described separately herein. Assuming for purposes of the present discussion the lower cavity 36 has previously been filled with coating material, the shuttle 116 is placed in the position shown in FIG. 5 by operation of the controller 128. Specifically, the controller 128 directs pressurized air through line 130 causing the cylinder 124 to retract its piston rod 126, thus moving the shuttle 116 to the discharge station 122. A completed fluid flow path is formed from the lower cavity 36 of pump 10, through its outlet 34 and into line 138 connected to the male coupling element 112 carried at the base of shuttle 116. With the shuttle 116 located at the discharge station 122, the male coupling element 112 thereon mates with the female coupling element 114 at the discharge station, which, in turn, is connected by a line 140 to one or more coating dispensers 102.

Coating material is forced from the lower cavity 36 by pressurization of the upper cavity 24 in the area above upper piston head 40. This is achieved by operation of the controller 128 which directs pressurized air via an air line 148 through the air inlet 19 in cap 18. Because the upper and lower piston heads 40 and 44 are interconnected by the connector rod 38, they move in tandem within the interior of their respective housings 12, 14, e.g., in a downward direction, in response to the application of pressurized air within the upper cavity 24 atop the upper piston head 40. The lower piston head 44 forces coating material within lower cavity 36 through the outlet 34 within base 28, and to the coating dispensers 102 via the fluid flow path described above.

The stem 68 of lower sensor 56 is mounted on the divider plate 20 in position to engage the bottom surface of the upper piston head 40 when the level of coating material within lower cavity 36 has reached a predetermined, minimum level. As noted above, both the upper and lower piston heads 40, 44 move in tandem in a downward direction as the coating material is forced from lower cavity 36, and thus upper piston head 40 moves downwardly within upper cavity 24 toward the lower sensor 56 as the lower cavity 36 is emptied of coating material. Upon contact of the upper piston head 40 with the lower sensor 56, the stem 68 thereof is forced further into the bore 62 within divider plate 20 so that the tapered element 82 at the end of stem 68 contacts and forces the ball 84 axially along bore 62, or to the "left" as the sensor 56 is drawn in FIG. 4. In turn, the ball 84 is pressed against the valve stem 86 of lower valve 64 causing it to open and transmit a pulse of air via line 144 to the controller 128. As noted above, the valve 64 receives pressurized air from source 134 through an air line 140.

In response to receipt of the air signal from valve 64, the controller 128 is operative to direct a flow of pressurized air through line 132 to the base of the cylinder 124 of voltage block device 104. This causes the piston 126 of cylinder 124 to extend and move in an upward direction, thus disengaging the shuttle 116 from the discharge station 122 and moving it to the filling station 110 where the male coupling element 112 at the filling station 110 mates with the female coupling element 114 carried on the top surface of the shuttle 116. With the shuttle 116 positioned at the filling station 110, a fluid flow path is formed from the coating material source 100, through line 106 to the filling station 110 and then through the mating coupling elements 112, 114 of the filling station 110 and shuttle 116 into fluid line 136 connected to the fluid inlet 32 in the base 28 of pump 10.

Coating material is transferred along the above-described flow path into the lower cavity 36 of pump 10 causing the upper and lower piston heads 40 and 44 to move in tandem in an upward direction as the lower cavity 36 fills with coating material. The pressurized air within the upper cavity 24 is exhausted through air inlet 19 and line 148 to allow for filling of the lower cavity 36. The upper and lower piston heads 40, 44 continue moving in an upward direction until the lower cavity 36 reaches a predetermined, maximum fill condition at which time the upper piston head 40 engages the stem 68 of the upper sensor 54 carried by the cap 18. The upper sensor 54 operates in the identical fashion as lower sensor 56 described above, and sends a signal from upper valve 60 through line 144 to the controller 128. Upon receipt of this signal, the controller 128 directs pressurized air through line 130 to the top of cylinder 124 causing its piston rod 126, and the shuttle 116 attached thereto, to move in a downward direction in the orientation of voltage block device 104 shown in FIG. 5. Downward movement of shuttle 116 causes it to disengage from the filling station 110 and return to the discharge station 122 in preparation for the transfer of coating material from the lower cavity 36 of piston pump 10 to one or more coating dispensers 102, as described above. The upper and lower sensors 54 and 56 therefore function as indicators of filled and empty conditions of the lower cavity 36 of pump 10, respectively, so that the shuttle 116 of voltage block device 104 can be transferred between the filling station 110 and discharge station 122 as appropriate.

An important aspect of the construction of the pumps 10 and 88 of this invention is the substantial reduction of cross-contamination or leakage between the pressurized air introduced into the upper cavity 24 and the coating material transmitted to and from the lower cavity 36. Further, wear of the seal 42 on the periphery of upper piston head 40, and the seal 46 carried by the lower piston head 44, is appreciably reduced. These advantages are achieved in part by allowing each of the upper and lower piston heads 40 and 44 to "center" themselves within their respective upper and lower housings 12, 14. As noted above, the connector rod 38 extends through the central bore 22 in divider plate 20, and no seals or bearings are employed to mount the connector rod 38 in place. Instead, the connector rod 38 is free to shift or pivot in essentially any direction within the central bore 22 with respect to its longitudinal axis. Such movement of the connector rod 38 allows both the upper piston head 40 and lower piston head 44 to shift or adjust to a more nearly concentric position with respect to the cylindrical walls 16 and 26 of upper and lower housings 12, 14, respectively. This eliminates the need for the upper and lower piston heads 40, 44 to be formed precisely concentric to their respective cylindrical walls 16, 26, while still obtaining an acceptable seal therebetween.

Additionally, a lubricant layer 48 is continuously maintained atop the lower piston head 44 within lower cavity 36. This lubricant layer 48 facilitates up and down movement of the lower piston head 44 within lower cavity 36, and provides a further barrier between the coating material on the bottom side 45 of lower piston head 44 within lower cavity 36 and the pressurized air within upper cavity 24 atop the upper piston head 40.

As mentioned above, the piston pump 88 shown in FIG. 3 is identical in operation to that of piston pump 10, and is structurally similar except for the difference in size of the lower housing 90 and lower cavity 94 of pump 88 compared to their counterparts in pump 10. It is contemplated that pump 88 would be employed in applications where greater pressure of the coating material discharged from lower cavity 94 is desirable or required. Such increase in pressure is achieved by reducing the diameter of lower cavity 94 while applying the same force on the lower piston head 44 through connector rod 38 and upper piston head 40 by the pressurized air introduced into the upper cavity 24. Otherwise, the operation of piston pump 88 is the same as that of piston pump 10.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Apparatus for pumping electrically conductive coating material, comprising:

a housing having an outer wall, first and second ends and a hollow interior;

a first piston head and a second piston head mounted at opposite ends of a connector rod and movable along said outer wall within said hollow interior of said housing, said second piston head having a first surface facing in a direction toward said first piston head, and a second surface;

said first and second piston heads dividing said hollow interior into a first cavity located between said first piston head and said first end of said housing, and a second cavity located between said second surface of said second piston head and said second end of said housing;

said housing being formed with an air passage to permit the introduction of pressurized air into said first cavity, and an air vent to permit the egress of air from said first cavity;

said housing being formed with a fluid inlet passage to permit the introduction of coating material into said second cavity and a fluid outlet passage through which coating material is discharged from said second cavity;

said housing having an inlet for the introduction of lubricant into said hollow interior to form a pool of lubricant on said first surface of said second piston head located at least in the area adjacent to said outer wall of said housing.

2. The apparatus of claim 1 in which each of said first and second piston heads mount a circumferentially extending seal engageable with said outer wall of said housing.

3. The apparatus of claim 1 in which said pool of lubricant covers the entire first surface of said second piston head and extends from said first surface in a direction toward said first piston head.

4. The apparatus of claim 1 further including a sensor carried by said first end of said housing in position to engage said first piston head once a selected quantity of coating material is introduced into said second cavity, said sensor being operative to produce a signal representative of the presence of said selected quantity of coating material within said second cavity.

5. The apparatus of claim 1 in which said housing includes a divider plate located between said first and second piston heads, said divider plate being formed with a bore which receives said connector rod.

6. The apparatus of claim 5 in which said divider plate mounts a sensor in position to engage said first piston once the quantity of coating material within said second cavity falls below a predetermined level, said sensor being operative to produce a signal indicative of the absence of coating material within said second cavity.

7. Apparatus for pumping electrically conductive coating material, comprising:

a housing having an outer wall, opposed first and second ends and a hollow interior;

a first piston head and a second piston head mounted at opposite ends of a connector rod;

a divider plate positioned between said first and second ends of said housing and separating said hollow interior into a first cavity within which said first piston head is axially movable and a second cavity within which said second piston head is axially movable, said connector rod extending though a bore formed in said divider plate;

a first sensor mounted to said divider plate in position to engage said first piston once the quantity of coating material within said second cavity falls below a predetermined level, said sensor being operative to produce a signal indicative of the absence of coating material within said second cavity;

said housing being formed with an air passage to permit the introduction of pressurized air into said first cavity, and an air vent to permit the egress of air from said first cavity;

said housing being formed with a fluid inlet passage to permit the introduction of coating material into said second cavity and a fluid outlet passage through which coating material is discharged from said second cavity.

8. The apparatus of claim 7 in which said bore formed in said divider plate has a greater diameter than the diameter of said connector rod so that each of said first and second piston heads can center themselves relative to that portion of said outer wall of said housing along which said first and second piston heads are axially movable.

9. The apparatus of claim 7 further including a second sensor carried by said first end of said housing in position to engage said first piston head once a selected quantity of coating material is introduced into said second cavity, said sensor being operative to produce a signal representative of the presence of said selected quantity of coating material within said second cavity.

10. The apparatus of claim 7 in which each of said first and second piston heads mount a circumferentially extending seal engageable with said outer wall of said housing.

11. Apparatus for supplying electrically conductive coating material, comprising:

a voltage block including a filling station adapted to connect to a source of coating material, a discharge station spaced from said filling station and being adapted to connect to at least one coating dispenser, and, a shuttle movable between said filling station and said discharge station;

a control device operative to control the movement of said shuttle between said filling station and said discharge station;

a pumping device, including:

(i) a housing having an outer wall, first and second ends and a hollow interior;

(ii) a first piston head and a second piston head mounted at opposite ends of a connector rod, each of said first and second piston heads being movable within said hollow interior and along said outer wall of said housing, said second piston head having a first surface facing in a direction toward said first piston head, and a second surface;

(iii) said first and second piston heads dividing said hollow interior of said housing into a first cavity located between said first piston head and said first end of said housing and a second cavity located between said second surface of said second piston head and said second end of said housing, said housing being formed with an air passage connected to said control device which is effective to direct pressurized air into said first cavity and a vent to permit the discharge of air from said first cavity, said housing being formed with a fluid inlet connected to said shuttle to permit the introduction of coating material from the source of coating material through said filling station and into said second cavity with said shuttle positioned at said filling station by operation of said control device, said housing being formed with a fluid outlet connected to said shuttle to permit the discharge of coating material from said second cavity through said discharge station and to a coating dispenser with said shuttle positioned at said discharge station by operation of said control device;

said housing having an inlet for the introduction of lubricant into said hollow interior to form a pool of lubricant on said first surface of said second piston head located at least in the area adjacent to said outer wall of said housing.

12. The apparatus of claim 11 in which said housing includes a divider plate located between said first and second piston heads, said divider plate being formed with a bore which receives said connector rod.

13. The apparatus of claim 12 in which said bore formed in said divider plate has a greater diameter than said connector rod so that each of said first and second piston heads can center themselves relative to that portion of said outer wall of said housing along which said first and second piston heads are axially movable.

14. The apparatus of claim 12 in which said divider plate mounts a first sensor in position to engage said first piston once the quantity of coating material within said second cavity falls below a predetermined level, said first sensor being operative to send a signal to said control device indicative of the absence of coating material within said second cavity, said control device being effective to cause said shuttle to move to said filling station in response to receipt of said signal.

15. The apparatus of claim 14 further including a second sensor carried by said first end of said housing in position to engage said first piston head once a selected quantity of coating material is introduced into said second cavity, said second sensor being operative to send a signal to said control device representative of the presence of said selected quantity of coating material within said second cavity, said control device being effective to cause said shuttle to move to said discharge station in response to receipt of said signal.

16. The apparatus of claim 15 in which each of said first and second sensors comprises:

a plunger having an outer end engageable with said first piston head, and a tapered inner end;

a valve mounted to said housing and connected to said control device, said valve including a valve stem extending into said housing;

a ball positioned between said tapered end of said plunger and said valve stem of said valve, said tapered end of said plunger being effective to engage and force said ball into contact with said valve stem in response to engagement with said first piston head at which time said valve sends said signal to said control device.

17. A method of pumping electrically conductive coating material, comprising:

(a) filling a first cavity of a pumping unit with coating material so that a first piston head and a second piston head mounted on opposite ends of a connector rod axially move in tandem in a first direction within the hollow interior of the pump housing while air is vented from a second cavity in the pump housing;

(b) introducing pressurized air into the second cavity in the pump housing within which the second piston head is axially movable to cause the first and second piston heads to move in tandem in a second direction so that coating material is discharged by the first piston head through an outlet in the first cavity;

maintaining a pool of lubricant on the surface of the first piston head which faces in a direction toward the second piston head, at least in an area adjacent to the wall of the pump housing to facilitate movement of the first piston head along the pump housing wall and to provide a barrier between the coating material within the first cavity and the pressurized air within the second cavity.

18. The method of claim 17 in which step (a) comprises filling the first cavity with coating material in response to the production of a signal resulting from engagement of the second piston head with a sensor carried within the hollow interior of the pump housing.

19. The method of claim 17 in which step (b) comprises introducing pressurized air into the first cavity in response to the production of a signal resulting from engagement of the second piston head with a sensor carried by one end of the piston housing.

20. The method of claim 17 in which step (c) comprises maintaining a pool of lubricant over the entire extent of the first surface of the first piston head.

21. Apparatus for pumping electrically conductive coating material, comprising:

a housing having an outer wall, first and second ends and a hollow interior;

a first piston head and a second piston head mounted at opposite ends of a connector rod and movable within said hollow interior, said second piston head having a first surface facing in a direction toward said second piston head, and a second surface;

said first and second piston heads dividing said hollow interior into a first cavity located between said first piston head and said first end of said housing, and a second cavity located between said second surface of said second piston head and said second end of said housing;

said housing being formed with an air passage to permit the introduction of pressurized air into said first cavity, and an air vent to permit the egress of air from said first cavity;

said housing being formed with a fluid inlet passage to permit the introduction of coating material into said second cavity, and a fluid outlet passage through which coating material is discharged from said second cavity;

a sensor located in said hollow interior of said housing, said sensor being effective to sense the position of one of said first piston head, said second piston head and said connector rod at least when the quantity of coating material falls below a predetermined level and to produce a corresponding signal indicative of the absence of coating material within said second cavity.

22. The apparatus of claim 21 further including a divider plate located within said housing between said first and second piston heads, said divider plate being formed with a bore which receives said connector rod.

23. The apparatus of claim 22 in which said sensor is mounted to said divider plate in position to engage said first piston head when the quantity of coating material within said second cavity falls below said predetermined level.

24. The apparatus of claim 21 in which each of said first and second cavities has a diameter, said diameter of said first cavity being larger than said diameter of said second cavity.

25. A method of pumping electrically conductive coating material, comprising:

(a) filling a first cavity of a pumping unit with coating material so that a first piston head and a second piston head mounted on opposite ends of a connector rod axially move in tandem in a first direction within the hollow interior of the pump housing while air is vented from a second cavity in the pumping housing;

(b) introducing pressurized air into the second cavity in the pump housing within which the second piston head is axially movable to cause the first and second piston heads to move in tandem in a second direction so that coating material is discharged by the first piston head through an outlet in the first cavity;

(c) sensing the position of one of the first piston head, the second piston head and the connector rod within the hollow interior of the pump when the quantity of coating material within the first cavity falls below a predetermined level, producing a corresponding signal, and, initiating step (a) in response to the signal.

26. The method of claim 25 further comprising sensing the position of one of the first piston head, the second piston head and the connector rod within the hollow interior of the pump when the quantity of coating material reaches a predetermined, filled level, producing a corresponding signal, and, initiating step (b) in response to the signal.

* * * * *